United States Patent [19]

Boissevain

[11] Patent Number: 4,786,529

[45] Date of Patent: Nov. 22, 1988

[54] CROSS DIRECTIONAL GLOSS CONTROLLER

[75] Inventor: Mathew G. Boissevain, Los Altos, Calif.

[73] Assignee: Measurex Corporation, Cupertino, Calif.

[21] Appl. No.: 62,886

[22] Filed: Jun. 15, 1987

[51] Int. Cl.[4] ..... B05D 3/12; B05C 11/02

[52] U.S. Cl. ..... 427/296; 34/114; 118/68; 118/101; 118/117; 427/361

[58] Field of Search ..... 118/101, 68, 115, 117, 118/118; 427/335, 296, 361, 362, 365, 366, 377, 378; 34/114

[56] References Cited

U.S. PATENT DOCUMENTS

| | | | |
|---|---|---|---|
| 3,853,604 | 12/1974 | Fleissner | 427/35 G X |
| 4,543,737 | 10/1985 | Boissevain | 34/92 |
| 4,580,355 | 4/1986 | Boissevain | 34/54 |

OTHER PUBLICATIONS

Tappi Journal/Feb., 1986, "Process Control and Automation of Supercalenders by Hannu Malkia.

*Primary Examiner*—Michael Lusignan

*Attorney, Agent, or Firm*—Spensley Horn Jubas & Lubitz

[57] ABSTRACT

A device for controlling the cross-directional gloss profile on the surface of a calenderable material by selectively directing jets of steam against sections of the material across its width. Built-in steam flow control valves are provided to control the amount of steam applied to each section. Suction means may also be provided to remove excess steam and thus prevent undesirable condensation on adjacent structures. The gloss finish may be monitored and compared to a desired gloss finish and the valves are activated accordingly.

22 Claims, 2 Drawing Sheets

CROSS DIRECTIONAL GLOSS CONTROLLER

BACKGROUND OF THE INVENTION

The present invention relates to the field of creating glossy surfaces on sheet materials, and more particularly to a device for controlling the cross-directional gloss profile of a paper sheet One of the parameters used in grading sheet materials is the gloss of the surface. For example, in the paper production process, various grades of paper having different surface gloss are produced to suit various applications. Typically, bulk paper is produced in a continuous sheet and wound in rolls having dimensions on the order of 25 feet or more in the cross direction (i.e. across the width of the sheet). Uniformity of gloss on the paper surface is often desirable or necessary. For example, in the situation where the roll of paper is cut to size for making various paper products, the consistency of the gloss of the individual paper items is dependent upon the uniformity of the gloss of the original bulk paper roll.

Paper production typically involves a calendering process which includes pressing paper material between calender rolls to obtain the desired physical characteristics. For example, calendering paper can change its density, thickness and surface features, including gloss. Gloss is typically created on the surface of the paper by applying steam to the paper surface, followed by pressing the paper between a series of calender rolls, typically arranged in a stack of alternating hard polished steel rolls and soft or reslient rolls made of cotton. The paper absorbs the steam and paper fibers at the surface are softened by the heat and moisture. As the polished steel calender roll comes into contact with the paper surface that has been treated with steam, it smooths the treated paper surface by pressing and rubbing actions against an adjacent cooperating roll to produce a glossy finish on the side of the paper facing the steel roll. The degree of gloss is dependent on the amount of moisture and heat and hence the amount of steam applied to the surface.

A common problem encountered in making a glossy finish using a steam treatment is the non-uniformity of the gloss finish of the calendered material. Localized variations in the amount of steam applied to the surface of the bulk paper may affect the uniformity of the gloss finish. Also, there are other variables in the calendering process such as temperature and calender roll pressure that may affect the amount of steam required for a particular degree of gloss. A more uniform gloss finish could be obtained if the amount of steam directed at the material could be controlled to vary independently for different sections of the paper surface.

Another common problem associated with the application of steam in calendering a gloss finish is that excess steam that has not been absorbed by the paper condenses on cool surfaces of the adjacent structure of the calender system. For example, the steam may condense on the steel calender roll which will wet the paper a the steel roll contacts the paper. The extra moisture from the steel calender roll in addition to the moisture applied directly to the sheet from the steam supply will affect the moisture distribution and hence the gloss finish and other physical properties of the paper. In addition, excess steam may condense on a cool portion of the paper surface at a location where steam treatment is not intended, thereby affecting the gloss profile.

Moreover, steam which condenses on cool surfaces forms water droplets which may drip on the paper as it passes through the system of calender rolls, thereby affecting the desired properties of the paper.

Certain types of devices for gloss finishing paper sheets include a steam box located within the pocket formed by paper sheet traveling from a polished steel roll in the calender stack to an adjacent idler roll, and from the idler roll back to the steel roll. The steam box is necessarily made small in order to fit within the pocket. The steam box directs steam at the paper surface in zones in the cross direction of the paper. Steam is supplied to the individual zones from an external steam generator. Pneumatically actuated control valves are used to control the amount of steam supplied to each zone.

The previously described device, however, is subject to certain limitations and inefficiencies. For example, due to the small size of the steam box, the steam control valves are located remotely from the steam box, i.e. outside of the steam box. Thus, the controlled flow of steam is delivered to each zone of the steam box through individual tubes leading from the control valves. However, as the number of zones increases, the number of tubes delivering steam to the various zones must also increase and thus the tube diameters decrease. These small diameter tubes may cause an uneven flow of steam to the steam box. For example, due to the small cross sectional area of the tubes, and the long length of the tubes leading from the remote steam control valves to the steam box, the heat energy of the steam may be lost through the walls of the tubes. As a result, condensation may occur within the tubes, thereby causing an undesirable two phase flow, i.e. a mixture of steam and water. Such flow is difficult to control and thus the actual amount of steam delivered to each zone is unpredictable.

In addition, the resistance to flow in the tubes increases with a decrease in tube diameter Hence, excessive power is required to deliver steam through the smaller tubes running between the steam box and the remote valves. Furthermore, due to the long length of tubes running between the steam box and the remote valves, there is a long lag in the response time when adjusting the amount of steam applied to the paper by means of the distant control valves. Consequently, with these types of devices, it is difficult to control the changes in steam distribution on the paper surface at a precise moment.

SUMMARY OF THE INVENTION

The present invention is directed towards a device for controlling the gloss finish on the surface of a calenderable sheet material, such as paper, by selectively directing jets of steam at variable flow rates against sections of the material across its width in the cross direction by means of built-in flow control valves spaced in the cross direction. The invention provides simple and efficient control of the steam distribution in the cross direction. The invention also provides a simple means for removing excess steam from the steam treatment area to prevent undesirable condensation on adjacent surfaces.

In the illustrated embodiment, the gloss controller of the present invention comprises a housing which spans the calenderable sheet of material in the cross direction. The gloss controller is positioned alongside the side of the material on which a gloss finish is desired and at a location before the material is pressed between a polished roll and an adjacent cooperating roll to create a gloss finish on the side of the material which contacts the polished roll. Within the gloss controller housing, individual plenums are provided each corresponding to one section of the material in the cross direction. Pressurized steam is delivered to the plenums by means of a main supply pipe leading to a nozzle in each plenum which discharges steam into the plenum. A plurality of orifices are provided on the housing to direct steam from each plenum at the side of the calenderable material which will be coming into contact with the polished roll. The amount of steam discharged through each nozzle is controlled by a valve located between the supply pipe and each nozzle. By controlling the volume of steam discharged by each nozzle, the steam distribution on the surface of the calenderable material may be controlled to adjust the gloss profile on the surface.

To prevent condensation of excess steam which may adversely affect the calenderable material, a vacuum plenum is provided in the gloss controller housing to remove excess steam through a slit in the housing. The slit is located on the same side of the housing alongside the material on which the orifices are located and downstream of the orifices in the direction of travel of the calenderable material. Steam discharged from the orifices deflects back and forth between the surface of the material and the adjacent surface of the housing, and at the same time moves downstream until the steam is sucked through the slit into the vacuum chamber. Therefore, the steam discharged through the orifices is able to treat a large area of the paper surface.

To maintain a uniform gloss finish on the calendered material, the gloss profile is monitored using a gloss sensor and the steam distribution is adjusted accordingly. A gloss sensor monitors the gloss profile on the surface at intervals in the cross direction of the material and generates a signal corresponding to the measured gloss. The signals from the sensor are fed to a valve control device which adjusts the valves in the gloss controller to thereby control the amount of steam applied to each section of the surface of the calenderable material in the cross direction.

DETAILED DESCRIPTION OF THE PREFERRED EMBODIMENT

The following description is of the best presently contemplated mode of carrying out the invention. This description is made for the purpose of illustrating the general principles of the invention and should not be taken in a limiting sense. The scope of the invention is best determined by reference to the appended claims. In the accompanying drawings, like numerals designate like parts in the several figures.

Figure 1:
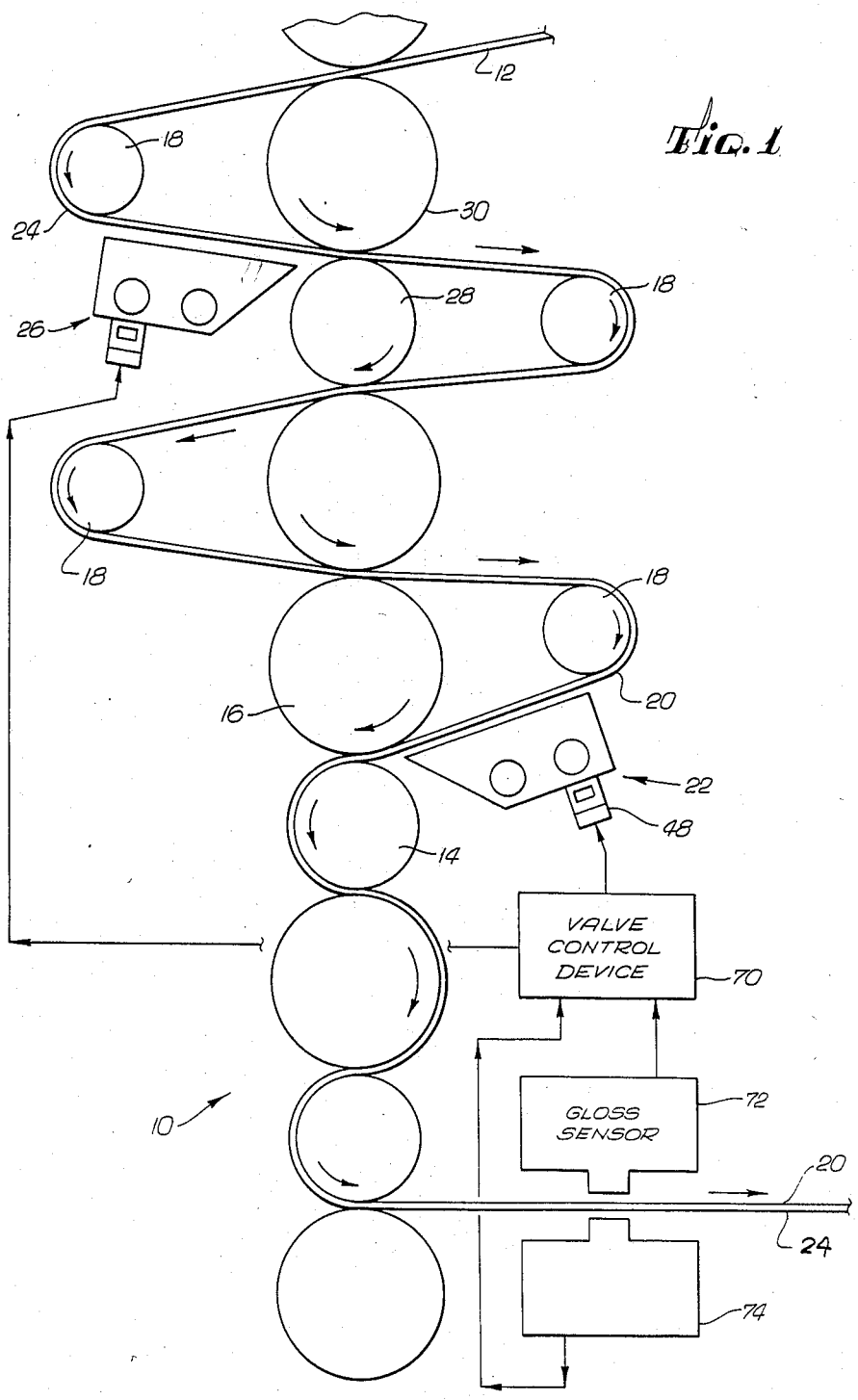
FIG. 1 is a side plan view illustrating a system of calender rolls for production of sheet material in which the present invention may be utilized to steam treat the material surface in preparation for a gloss finish.

FIG. 1 shows an example of a process in which the present invention may be applied. In particular, there is illustrated in FIG. 1 a system of calender rolls 10 suitable for pressing a sheet of calenderable material, such as paper 12. For convenience, the invention will be described hereinafter with reference to paper as the calenderable material. The system of calender rolls 10 includes at least one roll having a highly polished hard surface. Typically, the polished surface is made of steel. The polished roll will be referred to as steel roll 14 hereinafter. Provided adjacent to the steel roll 14 is a roll having a somewhat resilient surface which will be referred to hereinafter as a soft roll 16. The steel roll 14 and soft roll 16 and other rolls which may be hard or soft rolls may be arranged in a vertical stack wherein the paper passes between the rolls in a path of a general "S" configuration. Idler rolls 18 may be provided on the sides of the stack to facilitate the movement of the paper.

Gloss is created on one side of the paper sheet 12 as the paper passes between the steel roll 14 and its adjacent soft roll 16. Gloss is created only on the side 20 which has been treated with steam and which come into contact with the steel roll 14. A gloss controller 22 of the present invention is positioned adjacent this side 20 of the sheet 12 at a location upstream of the steel roll 14, with reference to the direction of travel of the paper, to direct steam at the paper surface as the surface approaches the steel roll 14. The steam softens the surface of the paper by action of the heat and moisture before the paper is pressed and squeezed by the steel roll 14 against the backing of the soft roll 16. A gloss finish is thus formed on the side 20 of the paper which has been treated with steam and which comes into contact with the steel roll 14. In order to form a gloss finish on the other side 24 of the paper, another gloss controller 26 working in conjunction with a steel roll 28 and a soft roll 30 may be employed in the same manner.

Figure 3:
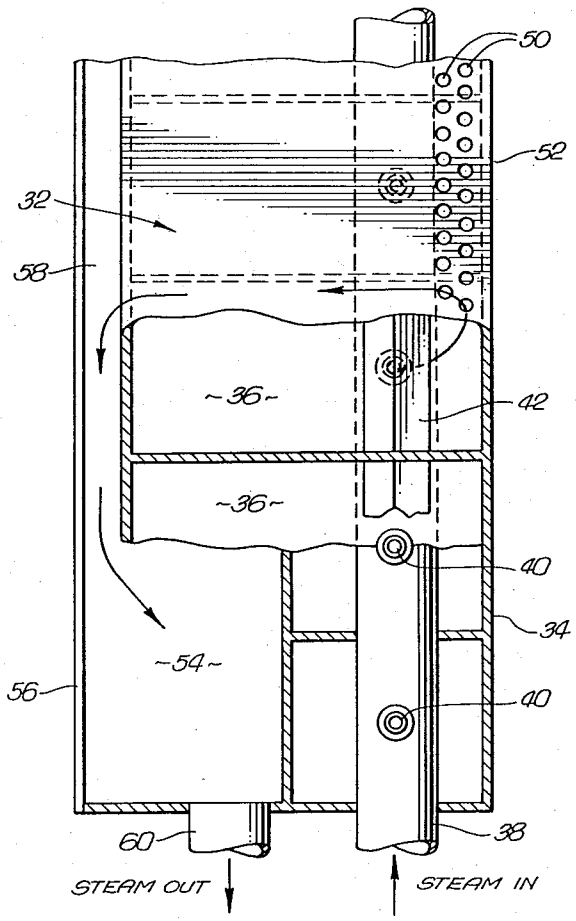
FIG. 3 is a top view, partially broken away, of the present invention taken along the line 3—3 of FIG. 2 illustrating a preferred arrangement of the orifices and the internal structure of the housing
Figure 2:
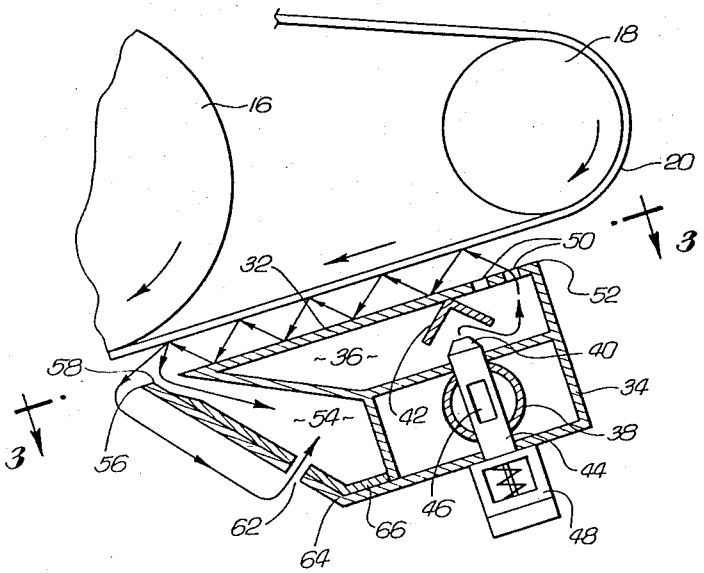
FIG. 2 is a cross-sectional view of an embodiment of the present invention illustrating a preferred internal structure of the housing.

The structure of the gloss controller of the present invention is described with reference to FIGS. 2 and 3. FIG. 2 is a cross-sectional view of an embodiment of the present gloss controller 22 and FIG. 3 shows the side 32 of the gloss controller 22 that is facing the paper surface 20. In the illustrated embodiment, the steam controller 22 comprises a housing 34 spanning the width of the sheet of paper, i.e. in the cross direction. Within the housing 34, individual plenums 36 are provided each corresponding to one section of the paper in the cross direction. Steam, which is preferably in a saturated state at 5 to 15 p.s.i. pressure, is delivered into the plenums by means of a main supply pipe 38 which releases steam into each plenum 36 through a nozzle 40. A V-shaped baffle 42 is provided in each plenum 36 in front of the nozzles 40 to facilitate dispersing the jet of steam discharged from the nozzles 40 into the plenums 36. The flow through each nozzle 40 is individually controlled by a valve 44 which includes a valve opening 46 in flow communication with the supply pipe 38 and the nozzle 40. The valve 44 is actuated by an actuator 48. The actuator 48 may be of an electro-magnetic type or preferably of an air piston type in view of the fact that the high temperature environment may affect the operation of an electro-magnetic actuator.

A plurality of orifices 50 are provided on the housing 34 on the side 32 which faces the paper surface 20. In the preferred embodiment shown in FIGS. 2 and 3, the orifices 50 are arranged in two rows near the leading edge 52 of the gloss controller 32, with reference to the direction of paper movement. These orifices 50 direct steam from the plenums 36 against the paper surface 20. Preferably, the orifices 50 are made small enough such that the steam is applied in the form of jets at the paper surface 20. The steam jets penetrate the paper surface 20 to facilitate absorption of heat and moisture to soften the paper fibers at the surface. The amount of steam released from each plenum 36 through the orifices 50 is dependent on the amount of steam discharged into the plenums 36 through the nozzles 40 which are controlled by the valves 44.

As illustrated by the arrows in FIG. 2, the portion of the steam not absorbed by the paper is deflected back and forth between the paper surface 20 and the side 32 of the controller housing 34 as the steam moves downstream in the direction of the paper movement. Each time the steam hits surface 20, some steam is absorbed by the paper. Hence, the steam discharged through the orifices 50 is able to treat a large area of the paper surface. As shown in FIG. 2, the plenums 36 are located just inside of the side 32 of the housing 34 so that the side 32 forms an external wall of the plenums 36. In this configuration, the steam in the plenums 36 keeps the side 32 warm to prevent condensation of the steam on side 32.

It can be seen that by means of the plurality of valves 44 spaced at intervals across the span of the gloss controller 22, the amount of steam applied to the surface 20 may be controlled to vary by a desired amount in the cross direction. A desired steam distribution profile in the cross direction may be controlled by selectively controlling each steam valve 44 associated with each plenum 36. Consequently, since the degree of gloss is dependent on the amount of steam applied to the surface, the gloss on each section of the paper surface corresponding to each plenum 36 of the gloss controller 22 in the cross direction may be controlled by supplying the appropriate amount of steam through the nozzles 40. Note however that it does not necessarily follow that, when different amounts of steam are supplied to the different plenums and hence to different sections of the paper surface, the gloss profile in the cross direction will not be uniform. In the situation where a uniform gloss profile in the cross direction is desired, it may be necessary to discharge different amount of steam through each nozzle in order to compensate for other variables in the paper making system which may affect the reaction of the paper surface to steam treatment.

It is apparent that by increasing the number of plenums and associated steam valves, that is, increasing the number of corresponding sections of the paper surface in the cross direction by decreasing the size of each plenum, the resolution of the gloss profile may be improved.

To prevent condensation of excess steam on structures adjacent to the steam treatment zone defined by the side 32 of the housing 34 and the paper surface 20 which would otherwise adversely affect the calendering process, a suction device may be provided in the gloss controller 22 to remove excess steam which would otherwise escape from the steam treatment zone. As shown in FIG. 2, a vacuum plenum 54 is provided within the housing 34. The vacuum plenum has an opening at the trailing edge 56 of the housing 34 and the opening is in the form of a slit 58 spanning the cross direction of the housing 34 as shown in FIG. 3. Excess steam that has reached the trailing edge 56 of the housing is sucked into the vacuum plenum 54 and out of the gloss controller 22 through a steam exhaust pipe 60. The steam suction confines the steam within the steam treatment zone to prevent undesirable condensation of excess steam on adjacent surfaces other than the paper surface 20 facing the gloss controller 22. Also, the vacuum suction induces the flow of steam from the orifices at the leading edge 52 of the housing toward the trailing edge 56 as the steam is deflected back and forth between the paper surface 20 and the side 32 of the housing 34. The steam can thus be effectively utilized to treat a large surface area of the paper before excess steam is sucked into the vacuum plenum.

As the steam travels along the side 32 of the housing 34, any condensation on the surface of the side 32 may also be sucked into the vacuum plenum 54. Moreover, in the arrangement shown in FIGS. 1 and 2, the inclination of the side of the housing 34 also provides a convenient means of draining condensed water droplets toward the slit 58 of the vacuum plenum 54.

Another slit 62 opening into the vacuum plenum 54 may optionally be provided on another side 64 of the housing 34. The additional slit 62 will further remove excess steam that was not removed by slit 58 and that has floated between the steel roll 14 and side 64 of the housing (FIG. 1). The suction through the slit 62 diverts steam away from the steel roll 14 which otherwise would condense on the steel roll.

To facilitate the flow of steam out of the vacuum plenum 54, the steam is maintained in a gaseous state in the vacuum plenum 54 by minimizing heat loss through the external wall of the plenum. Insulation material 66 such as fiberglass may be applied to the inside of the side 64 of the housing 34 which forms the external wall of the plenum 54.

As shown in FIG. 1, a computerized valve control device 70 may be employed to maintain a uniform gloss or a predetermined gloss profile on the paper surface. Gloss sensor 72 may be provided at a location downstream of the gloss controllers 22 to monitor the gloss on the paper surface 20. The gloss sensor 72 provides a signal corresponding to the degree of gloss of the surface to the control device 70. Depending on the deviation in the measured gloss of the paper surface from the desired gloss profile, the valve control device 70 selectively transmits control signals to the actuators 48 of the gloss controller 22 which in turn adjusts the associated steam valves 44 so that the valves 44 discharge the appropropiate amount of steam through the nozzles 40.

Typically, if the sensor 72 detects a higher gloss than desired on a section of the paper surface 20, the control device 70 adjusts the valve in the plenum 36 adjacent to that section and allows less steam to be applied to that section. As a result, less gloss is formed on that section of the surface 20 after it has been pressed by the steel roll 14. Alternatively, when the sensor 72 detects a lower gloss than desired, more steam is applied.

An additional gloss sensor 74 may be provided if there is a gloss finish on the other side 24 of the paper. The gloss sensor 74 operates in conjunction with the gloss controller 26. The same valve control device 70 may be used to control the valves in the gloss controller 26.

In summary, the present invention provides an apparatus for controlling the degree of gloss across a surface by selectively directing varying amount of steam against sections of the surface in the cross direction. Built-in control valves control the steam distribution in the cross direction. The invention also provides a simple means of removing excess steam from the steam treatment area to prevent undesirable condensation on adjacent surfaces. Gloss sensors maybe used to detect the degree of glossiness of the surface and a valve control device activates the valves in accordance with the detected gloss.

One preferred embodiment of the present invention has been described. Nevertheless, it will be understood that various modifications may be made without departing from the spirit and scope of the invention. For example, the side of the housing having the orifices may be curved to fit against a curved surface of calenderable material, such as around a roll. Also, the configuration of the orifices may be modified to be of smaller sizes and to be more closely spaced. Although the present invention is described with reference to the gloss of paper, the invention includes controlling, by steam treatment, physical characteristics other than gloss on different types of materials. Also, a working fluid other than steam may be employed without departing from the principles of the present invention. Accordingly, it is to be understood that the invention is not to be limited by the specific illustrated embodiments, but only by the scope of the appended claims.

We claim:

1. A gloss control system for controlling the formation of a gloss finish on a surface of a calenderable material, comprising:

a sheet of calenderable material having first and second opposing surfaces;

discharge means for discharging working fluid against a plurality of sections of the first surface of the material;

suction means disposed adjacent to said first surface for removing excess working fluid emitted by said discharge means and not absorbed by the first surface;

a calender roll having a smooth, hard, cylindrical surface; and means for pressing the first surface of said calenderable material against the smooth surface after the first surface has been contacted by the working fluid.

2. A gloss control system as in claim 1, further comprising control means for individually varying the amount of working fluid discharged by the discharge means against the respective sections of the first surface of the material.

3. A gloss control system as in claim 2, further comprising a housing, for the discharge means and the suction means, disposed adjacent to the first surface of the material, wherein the discharge means includes an array of orifices formed in a predetermined arrangement in a side of the housing adjacent to and facing the first surface.

4. A gloss control system as in claim 3, wherein the housing is disposed below the first surface of the material so that excess working fluid not absorbed by the first surface of the material can be collected on the side of the housing adjacent to the first surface, and wherein the suction means removes the excess working fluid from between the first surface and the housing.

5. A gloss control system as in claim 4, wherein the discharge means includes a fluid supply pipe disposed adjacent to the housing and wherein the control means includes flow control valves, each associated with a predetermined number of orifices, which control the flow of fluid from the fluid supply pipe to the orifices associated with the respective flow control valves.

6. A gloss control system as in claim 4, wherein the discharge means includes a plurality of plenums disposed in the housing each in flow communication with a predetermined number of orifices.

7. A gloss control system as in claim 4, wherein the suction means includes a vacuum plenum disposed in the housing and a first inlet, in flow communication with the vacuum plenum, formed in the side of the housing facing the first surface.

8. A gloss control system as in claim 7, wherein the orifices are disposed along one edge of the side of the housing facing the first surface of the material and the first inlet is disposed along the opposite edge of the same side of the housing.

9. A gloss control system as in claim 8, wherein the suction means further defines a second inlet, in flow communication with the vacuum plenum, disposed on another side of the housing adjacent to the side of the housing facing the first surface.

10. A gloss control system as in claim 2 wherein the control means includes:

gloss sensing means for determining the degree of gloss of the first surface and for producing a signal in response thereto;

flow control valves, each associated with a section of the first surface, for regulating the amount of working fluid discharged through the discharge means against the respective sections of the first surface; and valve control means for controlling each flow control valve in response to the signal from the gloss sensing means.

11. A gloss control system as in claim 4, wherein the calenderable material is paper and the working fluid is $H_2O$.

12. A gloss control system for controlling the formation of a gloss finish on a surface of a calenderable material, comprising:

a first calender roll having a hard, polished surface;

a second calender roll adjacent to the first calender roll and having a resilient surface and an axis of rotation substantially parallel to the axis of rotation of the first calender roll;

calenderable material having first and second opposing surfaces, said material being pressed between the first and second calender rolls such that the first surface contacts the first calender roll and the second surface contacts the second calender roll;

discharge means for discharging working fluid against different sections of the first surface before the material is pressed between the first and second rolls;

control means for individually varying the amount of working fluid discharged by the discharge means against the different sections of the first surface; and suction means for removing, from the first surface, excess fluid discharged by the discharge means.

13. A gloss control system as in claim 12, wherein the control means includes:

gloss sensing means for determining the degree of gloss on the surface of the calenderable material contacted by the first roll, and for producing a signal in response thereto;

flow control valves each associated with a section of the first surface for regulating the amount of working fluid discharged by the discharge means against the different sections of the first surface; and valve control means for controllilng each flow control valve in response to the signal from the gloss sensing means.

14. A gloss control system as in claim 12, wherein the calenderable material is paper and the working fluid is $H_2O$.

15. A method of controlling the formation of a gloss finish on a first surface of a calenderable material, comprising the steps of:

directing a working fluid at a plurality of different sections of the first surface;

individually controlling the amount of working fluid directed at each section of the first surface of the material;

removing, with suction, excess working fluid from the first surface, which fluid is not absorbed by the material; and pressing the first surface of the material against a hard, polished surface.

16. The method of claim 15, further comprising the steps of:

determining the degree of gloss of the first surface and producing a signal in response thereto; and regulating the amount of working fluid directed at each section of the first surface in accordance with the determined gloss.

17. A method as in claim 15, wherein the working fluid is $H_2O$ and the calenderable material is paper.

18. A fluid control system, comprising:

a moving web having a first major surface;

a member having a surface spaced from and adjacent to the first surface of the moving web, the surface of the member extending both in the direction of movement of the web and perpendicular to the direction of movement of the web;

supply means for directing a supply of fluid between the first surface of the web and the surface of the member; and suction means disposed adjacent to the first surface and spaced from the supply means along the direction of movement of the web, for removing fluid from between the first surface of the web and the surface of the member.

19. The system of claim 18, wherein the fluid is steam and the web is a paper web.

20. A gloss control system as in claim 9, wherein the side of the housing containing the second inlet and adjacent to the side of the housing facing the material surface further comprises an inclined surface angled away from the side of the housing facing the material surface.

21. The method of claim 15, further comprising the step of utilizing a calender roll having a smooth, hard, cylindrical surface as the hard, polished surface against which the first surface of the material is pressed.

22. A gloss control system as in claim 1, wherein the working fluid is steam and the material is paper.

* * * * *